US011242117B2

(12) United States Patent
Li et al.

(10) Patent No.: US 11,242,117 B2
(45) Date of Patent: Feb. 8, 2022

(54) MODULAR MULTIPURPOSE OFFSHORE OPERATION PLATFORM, INTEGRATED WORK PLATFORM, AND TRANSPORTATION METHOD

(71) Applicant: China Construction Steel Structure Corp. Ltd., Guangdong (CN)

(72) Inventors: Renge Li, Guangdong (CN); Huakun Li, Guangdong (CN); Tiao Yu, Guangdong (CN); Shaoyuan Peng, Guangdong (CN); Fei Zeng, Guangdong (CN); Shenxin Liu, Guangdong (CN); Zhe Hu, Guangdong (CN); Wei Xiong, Guangdong (CN); Yanchen Li, Guangdong (CN); Sixuan Huang, Guangdong (CN)

(73) Assignee: China Construction Steel Structure Corp. Ltd., Guangdong (CN)

( * ) Notice: Subject to any disclaimer, the term of this patent is extended or adjusted under 35 U.S.C. 154(b) by 61 days.

(21) Appl. No.: 16/620,552

(22) PCT Filed: Jun. 25, 2018

(86) PCT No.: PCT/CN2018/092646
§ 371 (c)(1),
(2) Date: Dec. 9, 2019

(87) PCT Pub. No.: WO2019/085520
PCT Pub. Date: May 9, 2019

(65) Prior Publication Data

US 2020/0164950 A1 May 28, 2020

(30) Foreign Application Priority Data

Nov. 3, 2017 (CN) ..... 201711068475.4

(51) Int. Cl.
*B63B 27/16* (2006.01)
*B63B 35/44* (2006.01)

(52) U.S. Cl.
CPC ..... *B63B 27/16* (2013.01); *B63B 35/44* (2013.01); *B63B 2221/02* (2013.01); *B63B 2231/04* (2013.01); *B63B 2231/50* (2013.01)

(58) Field of Classification Search
CPC ..... B63B 27/16; B63B 35/44; B63B 2221/02; B63B 2231/04; B63B 2231/50;
(Continued)

(56) References Cited

U.S. PATENT DOCUMENTS 4,604,962 A * 8/1986 Guibault ..... B63B 35/38 114/218
6,073,572 A * 6/2000 Gruhn ..... B63B 3/08 114/263
(Continued)

FOREIGN PATENT DOCUMENTS

CN 104627329 A 5/2015
CN 104875859 A 9/2015
(Continued)

OTHER PUBLICATIONS

ISA/CN, International Search Report for PCT Patent Application No. PCT/US2018/092646, dated Sep. 20, 2018, 3 pages.

*Primary Examiner* — Anthony D Wiest
(74) *Attorney, Agent, or Firm* — NK Patent Law

(57) ABSTRACT

A modular multipurpose offshore operation platform comprises a floating structure having a lower portion submerged below the surface of the sea, and a platform structure provided at an upper surface of the floating structure. An integrated work platform comprises at least two modular multipurpose offshore operation platforms. Framework structures of two adjacent operation platforms are detachably and fixedly connected, and floor boards of the operation
(Continued)

platforms collectively form a deck. A transportation method transports goods to the platform by means of a hoist, and a hoist bracket with a rotating roller. The platform can achieve standardized production, and is flexible and has multiple functions.

15 Claims, 2 Drawing Sheets

(58) Field of Classification Search
CPC B63B 21/30; B63B 35/38; B63B 3/08; B63B 2003/085
USPC ..... 114/264
See application file for complete search history.

(56) References Cited

U.S. PATENT DOCUMENTS

2002/0129755 A1* 9/2002 Hagen ..... B63B 27/10 114/268
2009/0084303 A1* 4/2009 Kazmierowicz ..... B63B 3/08 114/344

FOREIGN PATENT DOCUMENTS

| | | | |
|---|---|---|---|
| CN | 105672232 | A | 6/2016 |
| CN | 106114766 | A | 11/2016 |
| CN | 106379497 | A | 2/2017 |
| CN | 106516030 | A | 3/2017 |
| CN | 106864685 | A | 6/2017 |
| CN | 107878697 | A | 4/2018 |
| WO | 2008025234 | A1 | 3/2008 |

* cited by examiner

MODULAR MULTIPURPOSE OFFSHORE OPERATION PLATFORM, INTEGRATED WORK PLATFORM, AND TRANSPORTATION METHOD

CROSS REFERENCE TO RELATED APPLICATION

The present application is a U.S. National Stage Application of International Patent Application No. PCT/CN2018/092646, entitled "MODULAR MULTIPURPOSE OFFSHORE OPERATION PLATFORM, INTEGRATED WORK PLATFORM, AND TRANSPORTATION METHOD" filed on Jun. 25, 2018, which claims priority to Chinese Patent Application No. 201711068475.4, entitled "Modular Multipurpose Offshore Operation Platform" filed on Nov. 3, 2017, which are all incorporated herein by reference in their entireties.

TECHNICAL FIELD

The present application relates to the technical field of fishery equipment, and in particular to a modular multipurpose offshore operation platform, an integrated working platform, and a transportation method.

BACKGROUND

With the development of national economy, China has paid more and more attention to the marine culture industry, and more and more policy support and resources are tilting towards this industry, thus helping the transformation and upgrading of marine culture and strengthening the development of modern fishery.

In the traditional marine culture process, most of the traditional culture enterprises in the industry provide working faces of culture with the use of ships or homemade wooden rafts, and foam or plastic buckets are then placed under platforms to ensure that the rafts can float on the sea surface, so the fastness of connection is poor and the rafts easily loosen; and the ships with specific structures can be located only for transportation and are not suitable for marine culture.

In order to solve the above problems, the present culture enterprises set up fixed working faces on the sea surface to carry out corresponding culture, maintenance and the like. However, the marine construction environment is harsh. If fixed operation platforms are directly set up, the costs of the culture enterprises will be increased. In addition, due to the cyclical damage of typhoon, the operation platforms will increase the maintenance costs.

Therefore, it is extremely important to optimize the design of an offshore operation platform in terms of structure and function.

SUMMARY

The present application is mainly directed to propose a modular multipurpose offshore operation platform that achieves standardized production and is flexible and rich in function, an integrated working platform, and a transportation method, aiming at optimizing the design of an offshore operation platform in terms of structure and function.

In order to achieve at least one of the above objects, the present application proposes a modular multipurpose offshore operation platform, an integrated working platform, and a transportation method, the modular multipurpose offshore operation platform including a floating structure having a lower portion submerged below the surface of the sea, and a platform structure provided at an upper surface of the floating structure.

Further, the platform structure includes a horizontally arranged frame structure, a floor board is laid on the top surface of the frame structure, the floating structure includes at least one compartment, and the top part of the compartment is connected to the frame structure.

Further, the frame structure is rectangular, and two compartments are provided and are respectively disposed on two sides of the frame structure in the length direction.

Further, a gap is arranged between the two compartments.

Further, limit safety piles are fixedly disposed at end corners of the top surface of the frame structure, grooves are arranged at end corners of the floor board, and the grooves are engaged with the limit safety piles in one-to-one correspondence.

Further, the compartment is filled with a filler having a density smaller than the density of seawater.

Further, the frame structure is a steel frame welded by I-steel or channel steel, the floor board is a board subjected to preservative treatment, the compartment is a quadrangular compartment welded by a plurality of steel plates, and the filler is polyethylene foam.

Further, the surfaces of the steel frame and the quadrangular compartment are coated with a corrosion protection paint.

The other object of the present application is to provide an integrated working platform, including at least two modular multipurpose offshore operation platforms, wherein frame structures of two adjacent operation platforms are detachably fixedly connected, and floor boards of the operation platforms collectively form a deck.

Further, the frame structure of the operation platform is rectangular, and the long sides of two adjacent frame structures are correspondingly detachably fixed.

Further, a hoist bracket is hinged to the deck, and the free end of the hoist bracket can extend out of the deck; a hoist is also fixedly connected to the deck, the hoist includes a driving motor and a reel in transmission connection, the reel is wound with a wire rope, and the rotation direction of the reel is identical to that of the hoist bracket.

Further, two reels are provided, and the two reels are arranged side by side in a axial direction thereof and are in transmission connection with a driving end of the driving motor.

Further, fixing lugs are provided on the deck, and the fixing lugs are pivotally connected to the hoist bracket by a rotating shaft.

Further, the hoist bracket includes two longitudinal beams and a plurality of transverse beams, the two longitudinal beams are arranged in parallel, and the plurality of transverse beams are connected between the two longitudinal beams and are parallel to each other; two fixing lugs are provided, and the ends of the two longitudinal beams at a same end are respectively pivotally connected to the two fixing lugs through the rotating shaft.

Further, a support frame is fixed on the deck, the support frame is located outside the hoist bracket, and the hoist bracket may rotate outward to abut against the support frame.

Further, a rotating roller is pivotally connected to the free end of the hoist bracket. Further, a power system is provided on the operation platform, and the power system is configured to drive the operation platform to move on the sea.

Further, two power systems are provided, and the two power systems are respectively located on two sides of one end of the deck.

Further, the power system includes an engine, an adjusting rod and a propeller, a frame is fixed to the deck, the engine is fixed to the frame, one end of the adjusting rod is pivotally connected to the bottom of the frame, the propeller is pivotally connected to an other end of the adjusting rod, a driving end of the engine is connected to the propeller, and the engine is configured to drive the propeller to rotate.

Another object of the present application is to provide a transportation method configured to transport goods on the sea to a deck using the above integrated working platform, wherein the method comprises:

S100, abutting the hoist bracket against the support frame, extending the free end of the hoist bracket out of the deck, and lapping the wire rope wound on the reel onto the rotating roller;

S200, fixing goods on the sea to a free end of the wire rope;

S300, controlling the driving motor of the hoist to drive the reel to rotate along an axe thereof, thus the wire rope wound on the reel is tightened, and the goods supported by the supporting roller move from bottom to top along with the free end of the wire rope;

S400, making the free end of the wire rope reach the rotating roller, and the hoist bracket is rotated inward around a hinged joint thereof under a joint action of the goods and the wire rope; and

S500, rotating the free end of the hoist bracket to the deck, the hoist bracket is fixed, the goods are taken down from the wire rope, and the hoist bracket is rotated to an initial position.

The technical solutions of the present application have at least the following advantages over the prior art:

(1) Standardized production. In the operation platform of the technical solution of the present application, the compartment welded by steel plates, the steel frame structure, and the floor board disposed on the top part of the frame structure can be produced by factory standards, so the operation platform has higher quality over the operation platform built by manual binding or the like in the prior art, the production efficiency is relatively high, and the production cost and the labor cost can be greatly reduced. With the use of steel or other metal materials, the operation platform has certain recyclability.

(2) Flexibility. Because the operation platform of the technical solution of the present application can be produced in factory, a plurality of operation platforms can be fastened and connected by bolts to build a larger integrated working platform, which can be conveniently used or managed by workers through reasonable installation and configuration. The larger integrated working platform can be conveniently provided with corresponding devices to facilitate subsequent applications.

(3) Rich functions. In the technical solution of the present application, a plurality of operation platforms are fastened and connected, so that workers can set up different devices such as a hoist and power systems on the integrated working platform, workers can conveniently carry goods and transfer the integrated working platform to reduce the risk, and the maintenance cost is reduced accordingly. In addition, the compartment below the fixed frame structure may not be filled with a filler and be empty to meet the needs of workers for storing materials.

BRIEF DESCRIPTION OF THE DRAWINGS

To describe the technical solutions in the embodiments of the present application or in the prior art more clearly, the following briefly introduces the accompanying drawings required for describing the embodiments or the prior art. Apparently, the accompanying drawings in the following description show some embodiments of the present application, and persons of ordinary skill in the art may still derive other drawings from the structures shown by these accompanying drawings without creative efforts.

REFERENCE SIGNS

Figure 1:
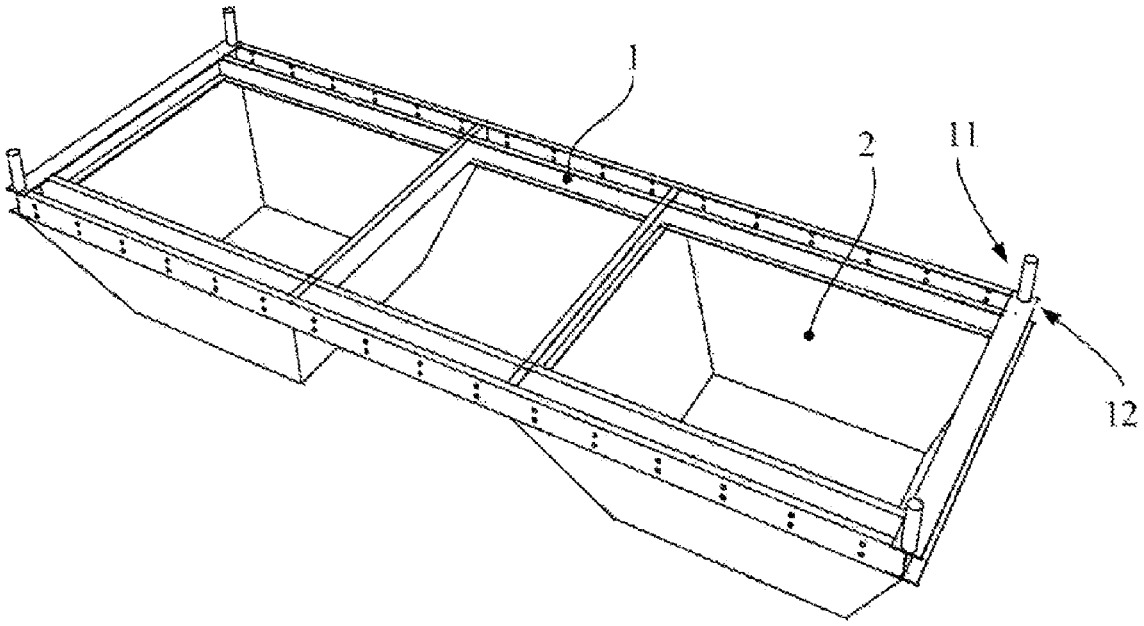
FIG. 1 is a schematic diagram of a three-dimensional structure of a modular multipurpose offshore operation platform according to an embodiment of the present application.

1—frame structure; 11—limit safety pile; 2—compartment; 3—floor board; 4—power system; 41—engine; 42—adjusting rod; 43—propeller; 44—frame; 5—hoist; 51—wire rope; 52—hoist bracket; 53—reel; 6—fixing lug; 7—rotating roller; 8—support frame.

The implementation, functional characteristics and advantages of the present application will be further described with reference to the accompanying drawings.

DETAILED DESCRIPTION

A clear and complete description will be made to the technical solutions in the embodiments of the present application below with reference to the accompanying drawings in the embodiments of the present application. Apparently, the embodiments described are only part of the embodiments of the present application, not all of them. All other embodiments obtained by those of ordinary skill in the art without creative efforts based on the embodiments of the present application shall fall within the protection scope of the present application.

It should be noted that, if directional indications (such as upper, lower, left, right, front, back, . . . ) are involved in the embodiments of the present application, the directional indications are only used to interpret relative positional relationships between components, motion statuses and the like in certain posture (as shown in the drawings), and if the specific posture changes, the directional indications also change.

The present application proposes a modular multipurpose offshore operation platform.

Referring to FIG. 1, the modular multipurpose offshore operation platform according to an embodiment of the present application includes a floating structure having a lower portion submerged below the surface of the sea, and a platform structure provided at an upper surface of the floating structure. Specifically, the platform structure includes a horizontally arranged frame structure 1, a floor board 3 is laid on the top surface of the frame structure 1, the floating structure includes at least one compartment 2, and the top part of the compartment 2 is connected to the frame structure 1. The compartment 2 of the operation platform is immersed in seawater, and supports the floating of the frame structure 1 and the floor board 3 by means of buoyancy of the seawater, so that the frame structure 1 and the floor board 3 can float above the sea surface. When offshore operation is required, operators can step on the floor board 3 on the frame structure 1 and carry out various operations on goods cultured on the sea surface. The frame structure 1 and the compartment 2 are fixedly connected with strong fastness, and the stability of the floor board 3 is correspondingly good, so the stability and balance are better, when the operators carry out various operations on the operation platform.

In this embodiment, as shown in FIG. 1, the frame structure 1 may be rectangular, two compartments 2 may be provided, and the two compartments 2 are respectively disposed on two sides of the frame structure 1 in the length direction. Here is a specific structure of the operation platform, the two compartments 2 are relatively independently disposed at two ends of the frame structure 1, the two compartments 2 simultaneously support the floating of the two ends of the frame structure 1, and the two fulcrums are provided such that the support force borne by the frame structure 1 is more uniform and the stability is better.

Specifically, in this embodiment, as shown in FIG. 1, a gap may be arranged between the two compartments 2. Compared with the arrangement of a large compartment 2, on the basis that the compartments 2 can support the floating of the frame structure 1, the compartments 2 support the frame structure 1 as two fulcrums on the one hand, so that the support stability is strong; on the other hand, when the seawater surges, the seawater can flow from the gap between the two compartments 2, thus reducing the resistance of water flow to the compartments 2, correspondingly reducing the driving force of the water flow to the compartments 2, and further improving the stability and balance of the operation platform; in addition, the two compartments 2 require a small amount of processing materials, which can effectively save materials and reduce production costs.

In this embodiment, the compartment 2 may be filled with a filler having a density smaller than the density of seawater. The filler is filled in the compartment 2 and occupies the space inside the compartment 2. When the seawater is immersed in the compartment 2, only a small space can accommodate the seawater, thereby reducing the occurrence of sinking of the entire operation platform when the seawater flows back into the compartment 2, and further improving the practicality of the operation platform. Specifically, the filler may be foam or the like.

In the embodiment of the present application, the frame structure 1 may be a steel frame welded by I-steel or channel steel, the floor board 3 may be a board subjected to preservative treatment, the compartment 2 may be a quadrangular compartment welded by a plurality of steel plates, and the filler may be polyethylene foam; and the surfaces of the steel frame and the quadrangular compartment of this embodiment are coated with a corrosion protection paint to reduce the corrosion damage of corrosive seawater to the corresponding steel frame and quadrangular compartment made of steel plates. Here is the specific form of each component on the operation platform, where the frame structure 1 is welded by multiple pieces of I-steel or channel steel or connected by connectors, so the fastness of connection is strong, the production is simple and convenient, mass production can be achieved, and the production cost can be effectively reduced; the surfaces of the floor board 3, the frame structure 1 and the compartment 2 are all coated with the corrosion protection paint, which can effectively reduce the corrosion damage to the components in contact with the seawater, effectively reduce the damage of the components such as breakage and leakage, and correspondingly prolong the service lives of the components and the operation platform.

The compartment 2 is a truncated quadrangular prism, the flared end of the quadrangular prism is connected to the frame structure 1, the reduced end is located at the bottom, and the quadrangular prism reduced from top to bottom can further reduce the impact force of seawater on the compartment 2 and improve the support stability of the compartment 2 to the frame structure 1 while floating; the reduced end of the compartment 2 can also be used for supporting to facilitate the placement of the operation platform on the land. Specifically, the compartment 2 may also be a truncated cone.

In order to reduce the occurrence of operator's fall caused by displacement of the floor board 3 when the operator is walking on the operation platform, in the embodiment of the present application, limit safety piles 11 may be fixedly disposed at end corners of the top surface of the frame structure 1, grooves 12 are arranged at end corners of the floor board 3, and the grooves are engaged with the limit safety piles 11 in one-to-one correspondence. The floor board 3 is clamped into the limit safety piles 11 of the frame structure 1 through the grooves 12, the floor board 3 is fixedly connected to the frame structure 1 correspondingly and cannot be displaced relative to the frame structure 1 in the horizontal direction, and when there is certain bump on the sea surface or the operator walks on the operation platform, the floor board 3 is not easily displaced, thereby ensuring the reliability of the operation platform and the balance of the operator on the operation platform; specifically, limit safety piles 11 may be disposed at four corners of the frame structure 1, and the four limit safety piles 11 simultaneously fix the four end corners of the floor board 3 to further improve the fixing fastness of the floor board 3; in addition, the limit safety piles 11 disposed at the end corners of the frame structure 1 facilitate the operator to bind other equipment or fix the operation platform.

Figure 2:
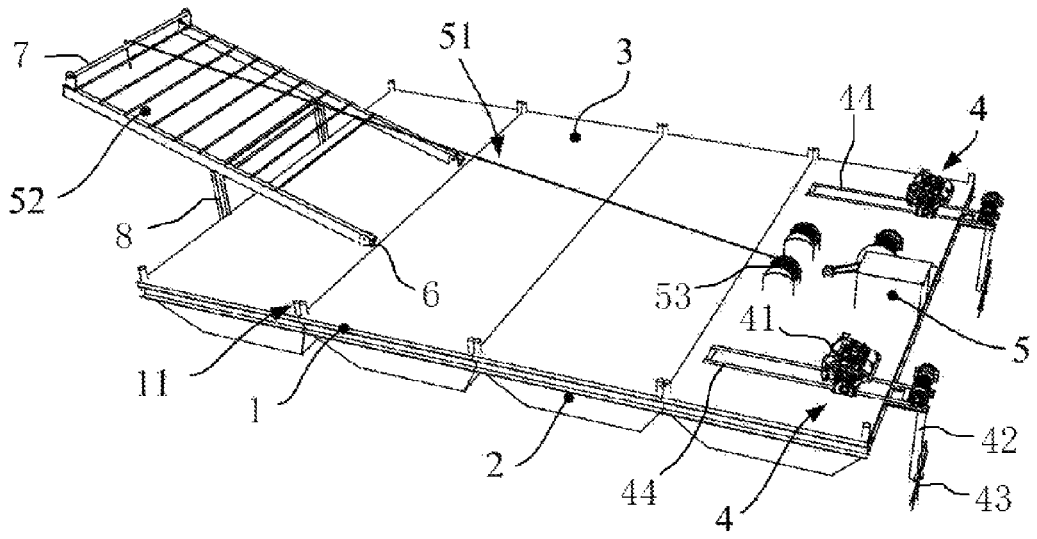
FIG. 2 is a schematic diagram of an integrated working platform according to an embodiment of the present application.

Referring to FIG. 2, an embodiment of the present application further provides an integrated working platform, including at least two modular multipurpose offshore operation platforms. Frame structures of two adjacent operation platforms are detachably fixedly connected, and floor boards of the operation platforms collectively form a deck. By building a large integrated working platform, workers can carry out work with a large work area. In addition to offshore operations, a plurality of operation platforms can be fastened together to build offshore trestle roads or recreational fishing platforms or the like, so the working platform has wide applications. Specifically, the frame structures 1 of adjacent operation platforms may be connected together by threaded fasteners, a plurality of connected operation platforms are fastened and connected to form an integrated working platform, and after the integrated working platform with large area is fastened by bolts, when maintenance or replacement is replaced, the operator only needs to loosen corresponding bolts and replaces the faulty operation platform, so the maintenance is convenient, few time is taken, and the cost is low.

Specifically, in this embodiment, the frame structure of the operation platform may be rectangular, and the long sides of two adjacent frame structures are correspondingly detachably fixed. The long sides of two or more operation platforms are connected together, the wide sides of the plurality of operation platforms together form the long side of the integrated working platform, the two compartments 2 on two sides of the plurality of operation platforms in the length direction are at the bottom of the integrated working platform, two rows of floating compartments are formed on two sides in the width direction (each row of floating compartments is composed of a plurality of compartments 2 on the same side of the plurality of operation platforms), and the two rows of floating compartments at the bottom of the integrated working platform support two ends as two fulcrums, so the support stability is stronger; and a passage is formed between the two rows of floating compartments (the gaps between the two compartments 2 on the plurality of operation platforms form the passage together), and the seawater can flow through the passage, thereby reducing the impact force and further improving the stability and balance.

That is, the integrated working platform assembled from a plurality of operation platforms is similar to a single operation platform in form, and has all the characteristics of the single operation platform.

In addition, after the plurality of operation platforms are fastened to build the integrated working platform, a hoist bracket 52 can be hinged to the deck, and the free end of the hoist bracket 52 can extend out of the deck; a hoist 5 is also fixedly connected to the deck 5, the hoist 5 includes a driving motor and reels 53 in transmission connection, the reels 53 are wound with wire ropes 51, and the rotation direction of the reels 53 is identical to that of the hoist bracket 52. The hoist bracket 52 can be rotated around a hinged joint on the deck. On the one hand, when the hoist bracket 52 is rotated to the outside of the deck, the operator can quickly build a temporary bridge with other operation platform or a bridge during landing. On the other hand, the hoist bracket 52 can be used as a bracket or swing arm to transport goods, thereby facilitating the carrying and transfer of goods or materials, and reducing the wear and damage of the deck when the wire rope 51 directly acts on the deck.

Specifically, the hoist 5 may include two reels 53, and the two reels 53 are arranged side by side in a axial direction thereof and are in transmission connection with a driving end of the driving motor. When goods to be transported are heavy, the two reels 53 can be used at the same time, and the free end of the wire rope 51 on the two reels 53 are connected with the goods to carry the goods together, thereby improving the bearing strength of the hoist 5 and the transportation stability of the goods, and reducing the occurrence of breakage of the single wire rope 51 when transporting goods or damage when the force bearing point of goods bears a large force. Specifically, the hoist 5 may be provided with one driving motor to drive the two reels 53 at the same time, or provided with two driving motors to drive the two reels 53 in one-to-one correspondence.

In this embodiment, fixing lugs 6 may be provided on the deck, and the fixing lugs 6 are pivotally connected to the hoist bracket 52 by rotating shafts. Here is a specific form of splicing of the hoist bracket 52 to the deck, where the fixing lugs 6 are disposed on the deck, and the fixing lugs 6 are hinged to the hoist bracket 52, so that on the basis of rotation of the hoist bracket 52 on the deck, the damage to the deck caused by direct connection of the hoist bracket 52 to the deck is reduced, and the support strength of the deck to the operator and goods is ensured.

Specifically, in this embodiment, the hoist bracket may include two longitudinal beams and a plurality of transverse beams, the two longitudinal beams are arranged in parallel, and the plurality of transverse beams are connected between the two longitudinal beams and are parallel to each other; two fixing lugs 6 may also be provided, and ends of the two longitudinal beams at a same end are respectively pivotally connected to the two fixing lugs 6 through the rotating shafts. Here is a specific form of the hoist bracket 52, where the plurality of transverse beams are supported between the two longitudinal beams to improve the relative fastness and support stability between the two longitudinal beams; when the hoist bracket 52 is used as a connected temporary bridge, the transverse beams can be for the operator to step on; in addition, the ends of the two longitudinal beams are correspondingly pivotally connected to the two fixing lugs 6, so the fastness of connection is stronger, and the hoist bracket 52 is more stable against the rotation of the deck.

In this embodiment, a support frame 8 may also be fixed on the deck, the support frame 8 is located outside the hoist bracket 52, and the hoist bracket 52 may rotate outward to abut against the support frame 8. When goods need to be transported, the hoist bracket 52 is rotated outward to lap the support frame 8, the wire ropes 51 bypass the hoist bracket 52 from above, the goods are connected to the free end of the wire rope 51 and suspended under the support of the hoist bracket 52 and rise constantly under the tightening action of the hoist 5 till the goods tightly abut against the hoist bracket 52, the hoist bracket 52 is rotated inward around a hinged joint thereof under a joint action of the goods and the wire ropes 51 to transport the goods to the deck, and the goods are taken down to complete the transportation. The support frame 8 supports the hoist bracket, which can reduce, on the one hand, the damage to the deck when the hoist bracket 52 is rotated to the outside and supported on the deck; and on the other hand, when the wire ropes 51 pull the hoist bracket 52 to rotate around the hinged joint, the support frame 8 supports the hoist bracket 52 within certain height and angle, which can effectively reduce the rotation angle of the hoist bracket 52 driven by the wire ropes 51, and correspondingly reduce the external work of the hoist 5.

In this embodiment, a rotating roller 7 may be pivotally connected to the free end of the hoist bracket 52. When the hoist bracket 52 is supported by the support frame 8, the wire ropes 51 bypass the rotating roller 7 to transport the goods. When the wire ropes 51 are continuously tightened onto the reels 53, the rotating roller 7 continuously rotates with the transmission of the wire ropes 51, and the rotating roller 7 can greatly reduce the friction at the time of movement relative to the wire ropes 51 while supporting the wire ropes 51, which can reduce the wear of the wire ropes 51 on the one hand and can also reduce the working resistance of the hoist 5 on the other hand.

In this embodiment, power systems 4 may be provided on the operation platforms, and the power systems 4 are configured to drive the operation platforms to move on the sea. During offshore operation, periodic typhoon attacks are usually encountered, and when the corresponding power systems 4 are disposed on the operation platforms, the operator can transfer the corresponding working platform to a safe area such as a harbor through the power systems 4 before the typhoon attacks, so as to reduce the damage caused by the typhoon to the working platform. In addition, the integrated working platform having certain power systems 4 can be used as an offshore rescue platform for people or goods that need rescue in an emergency, and therefore has wide applications.

In this embodiment, as shown in FIG. 2, two power systems 4 are provided, and the two power systems 4 are respectively located on two sides of one end of the deck. The two power systems 4 assist each other on the two sides of one end of the deck to adjust and drive the direction and position of the integrated working platform, with strong adjusting effect and enough driving force; in addition, when one of the power systems 4 fails, the other power system 4 can also separately adjust and drive the integrated working platform to further improve its practical performance.

Specifically, in this embodiment, as shown in FIG. 2, the power system may include an engine 41, an adjusting rod 42 and a propeller 43, a frame 44 is fixed to the deck, the engine 41 is fixed to the frame 44, one end of the adjusting rod 42 is pivotally connected to the bottom of the frame 44, the propeller 43 is pivotally connected to an other end of the adjusting rod 42, a driving end of the engine 41 is connected to the propeller 43, and the engine 41 is configured to drive the propeller 43 to rotate. Here is a specific form of the power system, where the engine 41, the adjusting rod 42 and the propeller 43 are fixed to the deck through the frame 44, and the engine 41 drives the propeller 43 to rotate so as to drive the integrated working platform to slide forward; the adjusting rod 42 is pivotally connected to the frame 44, and can rotate on the frame 44 to adjust the direction of the propeller 43, so that the propeller 43 adjusts the direction of driving force of the propeller 43 to the integrated working platform.

Specifically, the operation steps of a goods transportation method using the above integrated working platform are as follows:

S100, the hoist bracket 52 abuts against the support frame 8, the free end of the hoist bracket 52 extends out of the deck, and the wire ropes 51 wound on the reels 53 are lapped on the rotating roller 7; S200, goods on the sea are fixed to the free end of the wire rope 51; S300, the driving motor of the hoist 5 is controlled to drive the reels 53 to rotate along their axes, the wire ropes 51 wound on the reels 53 are tightened, and the goods supported by the supporting roller 7 move from bottom to top along with the free end of the wire rope 51; S400, the free end of the wire rope 51 reach the rotating roller 7, and the hoist bracket 52 is rotated inward around a hinged joint thereof under a joint action of the goods and the wire ropes 51; and S500, the free end of the hoist bracket 52 is rotated to the deck, the hoist bracket 52 is fixed, the goods are taken down from the wire ropes 51, and the hoist bracket 52 is rotated to an initial position.

It should be noted that the above steps are only operations, and their order is not fixed.

The foregoing descriptions are merely preferred embodiments of the present application, but are not intended to limit the patent scope of the present application. Any equivalent transformations made under the conception of the present application based on the description and accompanying drawings of the present application, or direct or indirect use in other relevant technical fields shall fall into the patent protection scope of the present application.

INDUSTRIAL PRACTICABILITY

According to the modular multipurpose offshore operation platform, the integrated working platform, and the transportation method provided by the embodiments, the fastness of connection between the components of the operation platform is strong, and the stability and balance are better, when the operator performs various operations thereon.

What is claimed is:

1. An integrated working platform, comprising at least two modular operation platforms, wherein frames of the at least two modular operation platforms are arranged adjacent to each other and are detachably fixedly connected, and floor boards of the at least two modular operation platforms collectively form a deck, a hoist bracket is hinged to the deck, and a free end of the hoist bracket extends out of the deck; a hoist is also fixedly connected to the deck, the hoist comprises a driving motor and a reel in transmission connection, the reel is wound with a wire rope, and a rotation direction of the reel is identical to that of the hoist bracket, and a rotating roller is rotatably connected to the free end of the hoist bracket, wherein each modular operation platform comprises a floating structure having a lower portion submerged below the surface of the sea, and a platform structure provided at an upper surface of the floating structure, wherein the platform structure comprises a rectangular frame, and the floor boards are laid on a top surface of the frame; wherein the lower portion comprises two compartments, and a top part of the compartments is connected to the frame, and wherein the two compartments are respectively disposed on two sides of the frame in a length direction.

2. The integrated working platform of claim 1, wherein a gap is arranged between the two compartments.

3. The integrated working platform of claim 1, wherein limit safety piles are fixedly disposed at end corners of the top surface of the frame, grooves are arranged at end corners of the floor boards, and the grooves are engaged with the limit safety piles in one-to-one correspondence.

4. The integrated working platform of claim 1, wherein the two compartments are filled with a filler having a density smaller than the density of seawater.

5. The integrated working platform of claim 4, wherein the frame is a steel frame welded by I-steel or channel steel, the floor are subjected to preservative treatment, each of the two compartments is a quadrangular compartment welded by a plurality of steel plates, and the filler is polyethylene foam.

6. The integrated working platform of claim 5, wherein surfaces of the steel frame and each quadrangular compartment are coated with a corrosion protection paint.

7. The integrated working platform of claim 1, wherein long sides of two adjacent frames are correspondingly detachably fixed.

8. The integrated working platform of claim 7, further comprising a second reel, and wherein said reel and said second reel are arranged side by side in an axial direction thereof and are in transmission connection with a driving end of the driving motor.

9. A transportation method configured to transport goods on the sea to a deck using the integrated working platform of claim 8, comprising:

abutting the hoist bracket against the frame, extending the free end of the hoist bracket out of the deck, and lapping the wire rope wound on the reel onto the rotating roller;

fixing goods on the sea to a free end of the wire rope;

controlling the driving motor of the hoist to drive the reel to rotate along an axe thereof, thus the wire rope wound on the reel is tightened, and the goods supported by the supporting roller move from bottom to top along with the free end of the wire rope;

making the free end of the wire rope reach the rotating roller, and the hoist bracket is rotated inward around a hinged joint thereof under a joint action of the goods and the wire rope; and rotating the free end of the hoist bracket to the deck, the hoist bracket is fixed, the goods are taken down from the wire rope, and the hoist bracket is rotated to an initial position.

10. The integrated working platform of claim 1, wherein a fixing lug is provided on the deck, and the fixing lug is pivotally connected to the hoist bracket by a rotating shaft.

11. The integrated working platform of claim 1, wherein the hoist bracket comprises two longitudinal beams and a plurality of transverse beams, the two longitudinal beams are arranged in parallel, and the plurality of transverse beams are connected between the two longitudinal beams and are parallel to each other; two fixing lugs are provided, and ends of the two longitudinal beams at a same end are respectively pivotally connected to the two fixing lugs through the rotating shaft.

12. The integrated working platform of claim 1, wherein a support frame is fixed on the deck, the support frame is located outside the hoist bracket, and the hoist bracket may rotate outward to abut against the support frame.

13. The integrated working platform of claim 1, wherein a power system is provided on the operation platforms, and the power system is configured to drive the operation platforms to move on the sea.

14. The integrated working platform of claim 1, wherein two power systems are provided, and the two power systems are respectively located on two sides of one end of the deck.

15. The integrated working platform of claim 14, wherein each power system comprises a respective engine, a respective adjusting rod and a respective propeller, a respective frame is fixed to the deck, the respective engine is fixed to the respective frame, one end of each respective adjusting rod is pivotally connected to a bottom of the respective frame, each respective propeller is pivotally connected to an other end of the respective adjusting rod, a driving end of each respective engine is connected to the respective propeller, and the respective engine is configured to drive the respective propeller to rotate.

* * * * *